US006764298B2

(12) United States Patent
Kim et al.

(10) Patent No.: US 6,764,298 B2
(45) Date of Patent: Jul. 20, 2004

(54) METHOD FOR CONTROLLING AIR FUEL RATIO IN GAS FURNACE

(75) Inventors: Ji Won Kim, Pusan-shi (KR); Young Soo Kim, Kyongsangnam-do (KR); In Kyu Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 09/927,466

(22) Filed: Aug. 13, 2001

(65) Prior Publication Data

US 2002/0150850 A1 Oct. 17, 2002

(30) Foreign Application Priority Data

Apr. 16, 2001 (KR) ..... 2001-20179

(51) Int. Cl.[7] ..... F23N 1/02
(52) U.S. Cl. ..... 431/12; 431/89; 431/90
(58) Field of Search ..... 431/90, 12, 89, 431/6, 18, 20, 62; 236/15 BD

(56) References Cited

U.S. PATENT DOCUMENTS 4,468,192 A * 8/1984 Jaeger ..... 431/20
4,622,004 A * 11/1986 Dalhuisen ..... 431/76
4,913,128 A * 4/1990 Adachi ..... 122/14.21
4,994,959 A * 2/1991 Ovenden et al. ..... 700/33
5,222,888 A * 6/1993 Jones et al. ..... 431/20
5,458,294 A * 10/1995 Zachary et al. ..... 239/585.5
5,513,979 A * 5/1996 Pallek et al. ..... 431/90
5,590,642 A * 1/1997 Borgeson et al. ..... 126/116 A
5,634,786 A * 6/1997 Tillander ..... 431/90
5,658,140 A * 8/1997 Kondou et al. ..... 431/90
5,791,332 A * 8/1998 Thompson et al. ..... 126/116 A
6,116,230 A * 9/2000 Clifford et al. ..... 126/39 BA

FOREIGN PATENT DOCUMENTS

JP 02-13709 * 1/1990 ..... 431/12
JP 05-118537 * 5/1993 ..... 431/12

* cited by examiner

*Primary Examiner*—Carl D. Price
(74) *Attorney, Agent, or Firm*—Fleshner & Kim, LLP

(57) ABSTRACT

A method is provided for controlling an air fuel ratio in a gas furnace which can maintain optimum performance in combustion, irrespective of variation in temperature control stages. Air quantity and fuel quantity are integrally, rather than separately, controlled through the detection and adjustment of variation in each until the air fuel ratio reaches an objective value. In this manner, transient phenomena caused during the burning operation is prevented, and optimum combustion performance is maintained regardless of the temperature variation.

10 Claims, 6 Drawing Sheets

METHOD FOR CONTROLLING AIR FUEL RATIO IN GAS FURNACE

BACKGROUND OF THE INVENTION

1. Field of the Invention

The present invention relates to a gas furnace, and more particularly, to a method for controlling an air fuel ratio in a gas furnace.

2. Background of the Related Art

FIG. 1 illustrates a construction of a general gas furnace. Referring to FIG. 1, the general gas furnace includes a burner 11 for mixing air with fuel gas and burning the mixture, an igniter for igniting the mixture of the air and the fuel gas, a flame sensor for sensing flame, a gas valve 12 for supplying and excluding the fuel gas, an inducer fan 13 for supplying the combustion air to the burner 11, a first heat exchanger 14 and a second heat exchanger 15 for heating outside air through the burning operation of the burner 11, a blower 16 for circulating the air to transfer the heat transferred through the first and second heat exchangers 14 and 15 to the inside of a room, a controller (not shown) for controlling operation of each component of the gas furnace according to a user's operation command or a preset operation condition, and a memory (not shown).

A heating cycle of the gas furnace constructed as above will be explained herein below with reference to FIG. 2.

Firstly, once the controller is turned on, it drives the inducer fan 13 for a predetermined period of time and performs a pre purge stroke to discharge a residual gas or the likes remaining during a pre-burning operation.

The controller supplies a power source to the igniter to heat the igniter for a predetermined period of time. In a state that an ignition condition is satisfied, the controller opens the gas valve 12 and supplies the fuel gas to the burner 11.

After the controller opens the gas valve 12 for the predetermined period of time, it cuts off the supply of the power source to the igniter.

At the same time, the controller senses flame by means of the flame sensor to know whether the ignition is exactly carried out for the period of time after the gas valve 12 is opened. If there is sensed the flame, the controller turns on the blower 16 after a predetermined period of time, so as to proceed with a normal combustion.

The controller measures an indoor temperature through a temperature sensor. If the temperature reaches a preset temperature, the controller closes the gas valve 12 to extinguish fire, and drives the inducer fan 13 and the blower 16 for a predetermined period of time to perform a post purge stroke for the purpose of cooling the inside of the gas furnace and discharging a residual gas inside the gas furnace.

Next, the controller turns off the inducer fan 13, and drives only the blower 16 for a predetermined period of time so as to complete the fire extinguishing.

The controller performs the heating operation by reiterating the above burning and extinguishing process according to the preset heating temperature condition and the user's operation command.

A method for controlling an air fuel ratio in the gas furnace of the conventional art will be explained herein below.

The conventional gas furnace is provided with one or more temperature control modes, such as strong/intermediate/weak modes, etc., so as for the user to select a desired temperature.

The strong/intermediate/weak modes are set to have corresponding calorific values: 6000 Kcal/hour for the strong mode, 5000 kcal/hour for the intermediate mode, and 3000 Kcal/hour for the weak mode. An air fuel ratio suitable for each calorific value has been set through experiments. Thus, if the user selects the strong mode, the gas valve 12 and the inducer fan 13 are controlled to supply the air and the fuel at the preset air fuel ratio which is suitable for generating heat of 6000 Kcal/hour. Then, if the user changes the temperature to the weak mode, the gas valve 12 and the inducer fan 13 are controlled to supply the air and the fuel at the preset air fuel ratio which is suitable for generating heat of 3000 Kcal/hour.

At this time, gas fuel quantity is controlled in a manner that magnetic field strength of a solenoid in the inside is varied according to a voltage supplied to the gas valve 12 and opening of the gas valve 12 is accordingly varied. Air quantity is controlled by a revolution of a fan motor which drives the inducer fan 13. Therefore, the controller has to detect the revolution to control the revolution of the fan motor. The process for detecting the revolution will be explained herein below.

The controller applies an operation voltage to the fan motor to drive the fan motor, which is accordingly operated after receiving the operation voltage. As the fan motor is operated, pulse signals are generated in a pulse signal generating part connected to the fan motor in proportion to the revolution.

Therefore, as shown in FIG. 3*a*, the number of pulses output in the pulse signal generating part of the fan motor is counted at constant time intervals, namely every second, to detect the revolution of the fan motor, whereby the revolution of the fan motor is renewed every second.

Meantime, in the event that the gas combustion condition is drastically changed, for example, the mode is changed from the weak mode to the strong mode, as shown in FIG. 3*b*, pulse recurrence intervals are varied several times for a second. As a result, the number of pulses is varied, and the revolution per minute (RPM) of the fan motor is also varied. In this case, the fan motor RPM cannot be exactly detected.

In the gas furnace of the conventional art, if the temperature control stage is varied, the air fuel ratio is varied instantaneously in accordance with the varied temperature control stage. That is to say, since the fan motor RPM has to be rapidly varied and the opening of the gas valve has to be rapidly varied to supply the air and the gas at the varied air fuel ratio, there inevitably exists a transient state, namely a state that the air fuel ratio is improper, wherein the combustion is unstable, excessive exhaust gas is generated, and an abnormal termination of the combustion is occurred because of environmental conditions and factors, thereby deteriorating performance in combustion.

SUMMARY OF THE INVENTION

Accordingly, the present invention is directed to a method for controlling an air fuel ratio in a gas furnace that substantially obviates one or more problems due to limitations and disadvantages of the related art.

An object of the present invention is to provide a method for controlling an air fuel ratio in a gas furnace, which can maintain optimum performance in combustion irrespective of variation in temperature control stages.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for controlling an air fuel ratio in a gas furnace which drives a fan motor with a specified voltage, measures a cycle time of pulse signals generated during revolution of the fan motor, detects the number of revolutions of the fan motor according to the measured cycle time, and controls opening of a gas valve based on an average voltage of a PWM(Pulse Width Modulation) signal applied from a controller, the method including the steps of detecting data of variation in calorific value according to variation in a PWM count value, and data of variation in air quantity according to variation in the RPM(Revolution Per Minute) of the fan motor; detecting data of variation in the PWM count value according to the variation in the fan motor RPM by using the above calorific value variation data and the air quantity variation data variation data, and deriving a relational expression between the fan motor RPM and the PWM count value by using the PWM signal count value variation data; and applying the detected RPM to the relational expression until a calorific value reaches a level preset in a temperature control mode selected by a user during a burning operation of the gas furnace, and accordingly controlling a gas valve with the PWM count value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
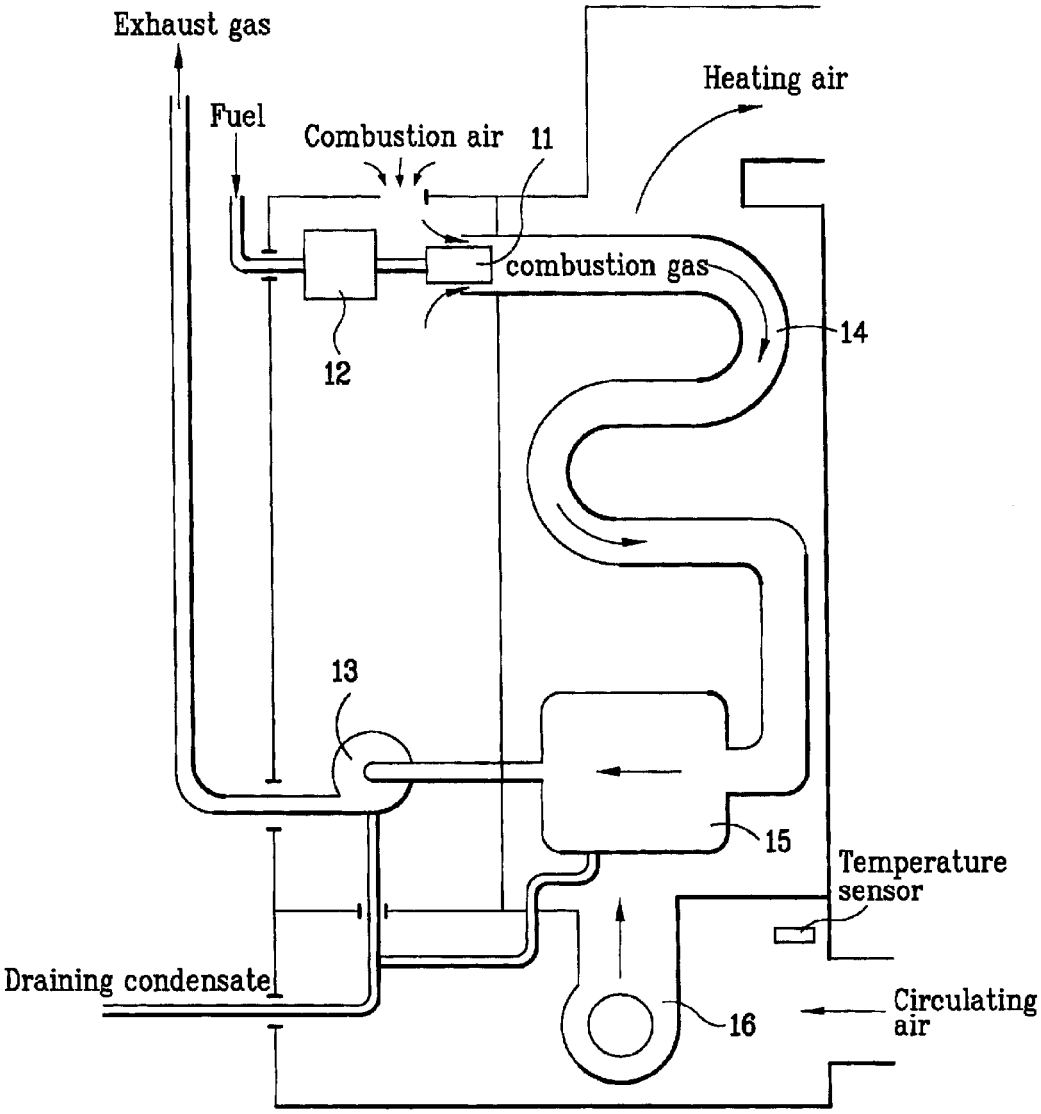
FIG.1 Related Art
FIG. 1 illustrates a sectional view of a construction of a general gas furnace.
Figure 2:
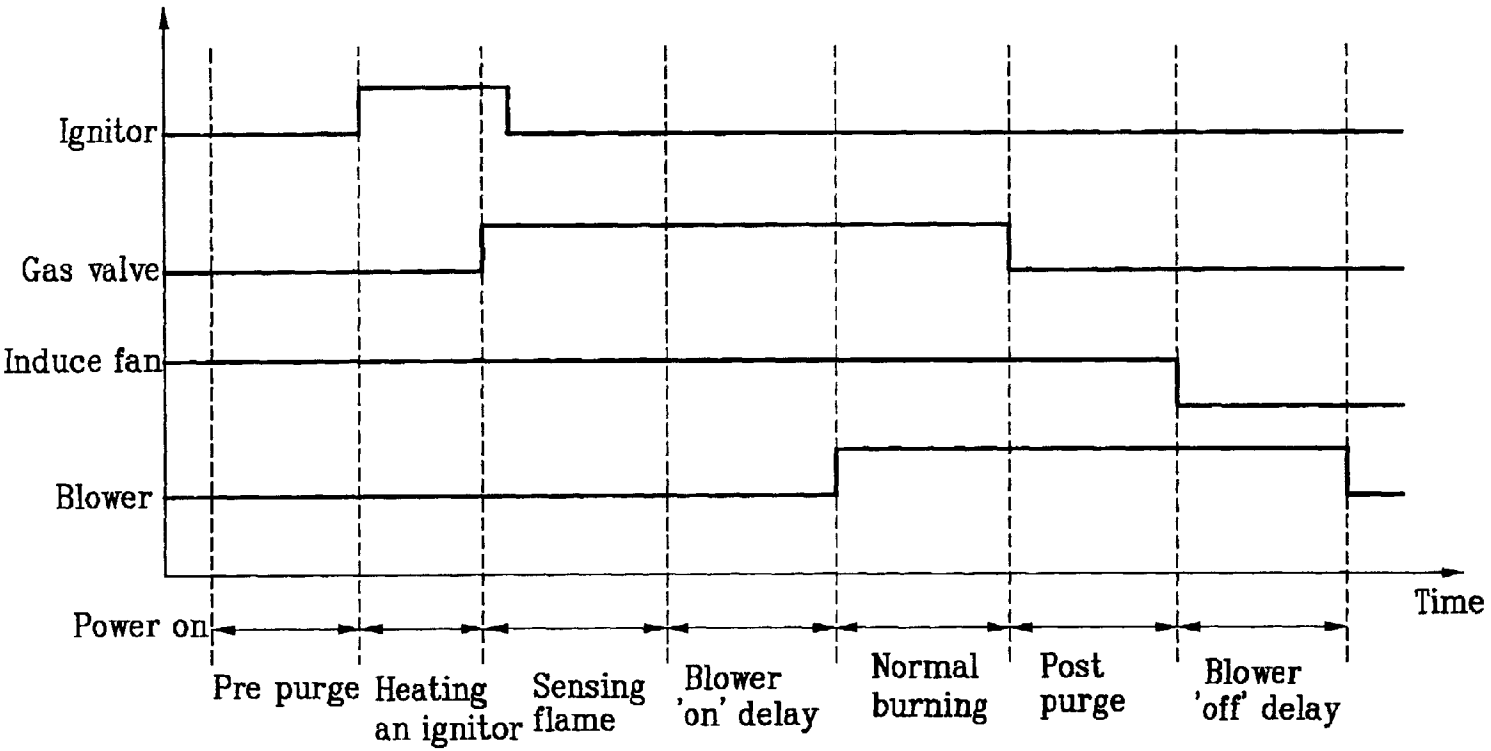
FIG.2 Related Art
FIG. 2 illustrates a timing diagram for explaining a burning operation of the general gas furnace.
Figure 3A:
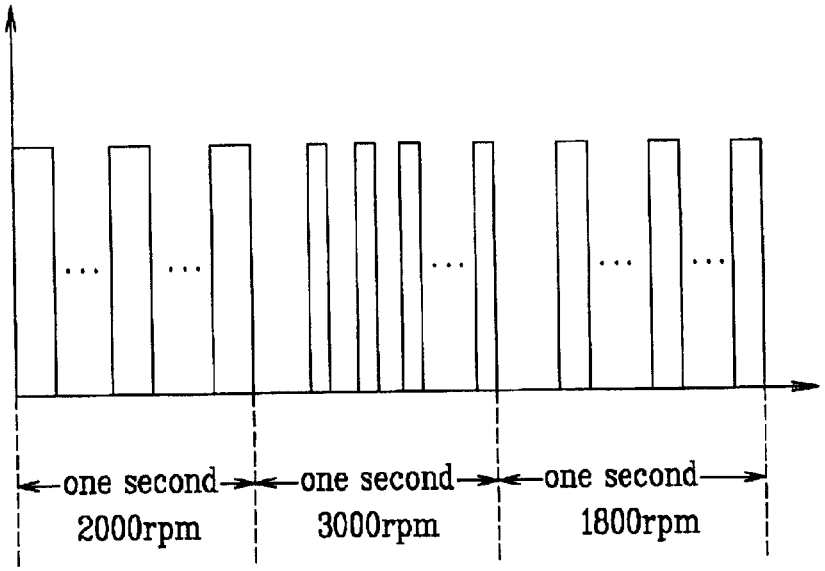
FIG.3A Related Art
FIGS. 3*a* and FIG. 3*b* illustrate views for explaining a process of sensing a velocity of a fan motor in a conventional gas furnace.
Figure 3B:
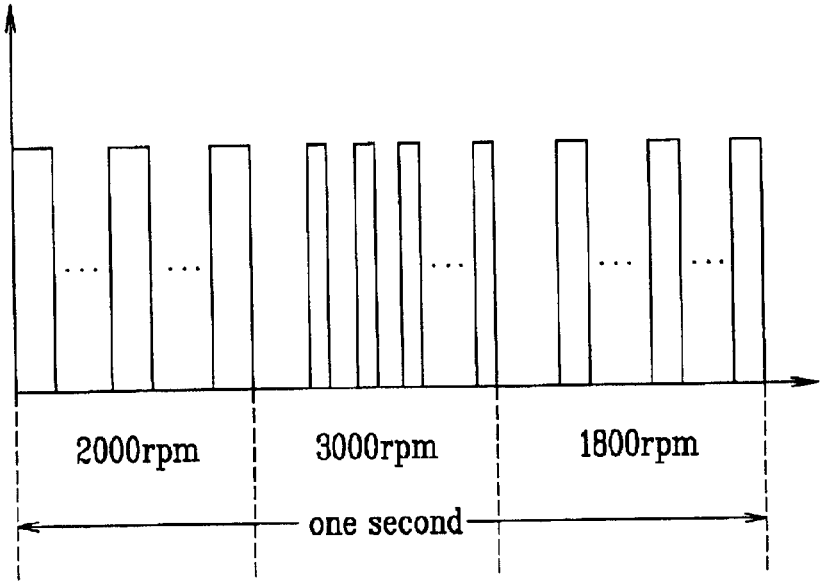
FIG.3B Related Art
Figure 4:
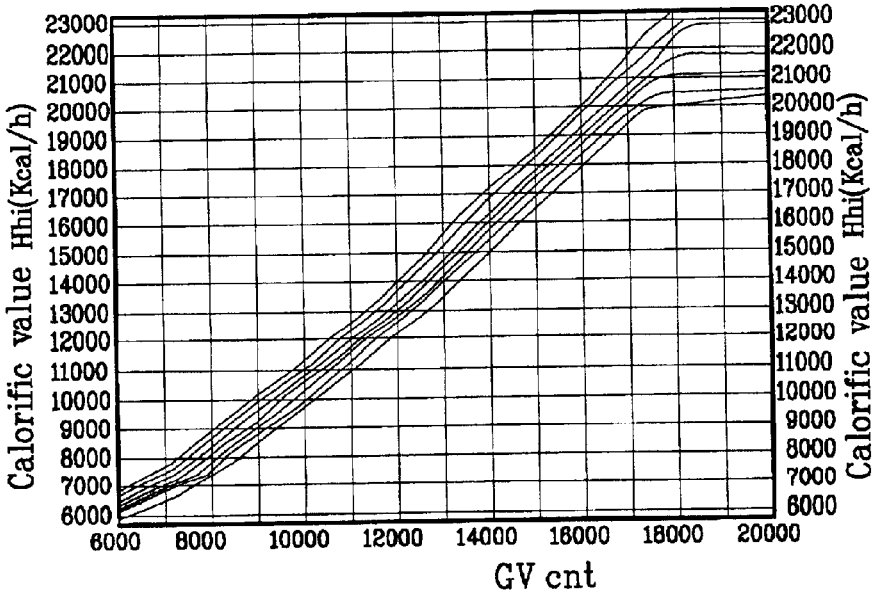
FIG. 4 illustrates a graph of a calorific value according to a PWM count value of a gas valve according to the present invention.
Figure 5:
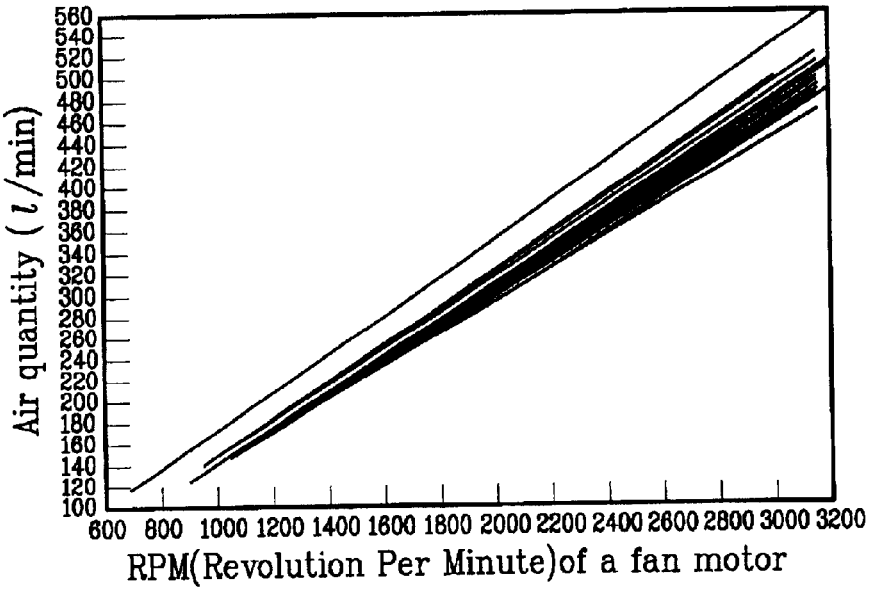
FIG. 5 illustrates a graph of an air quantity according to an RPM(Revolution Per Minute) of a fan motor according to the present invention.
Figure 6:
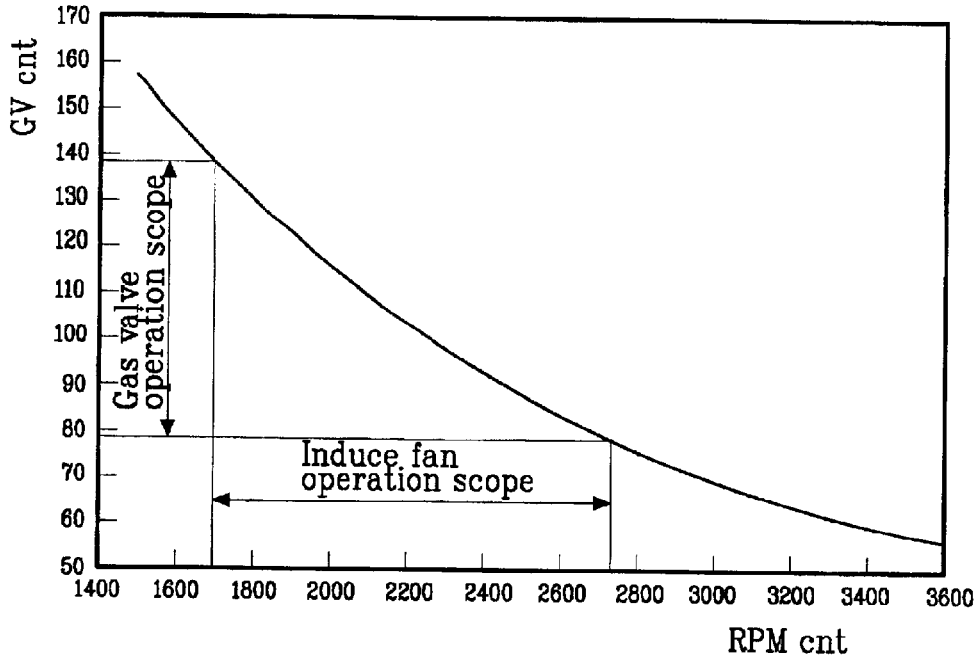
FIG. 6 illustrates a graph of a calorific value control according to the present invention.
Figure 7:
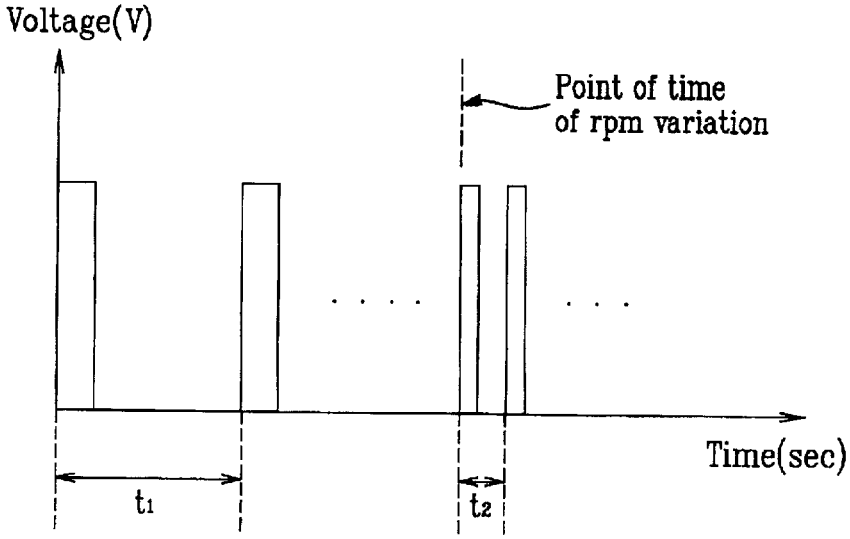
FIG. 7 illustrates a first preferred embodiment of a method for sensing a velocity of a fan motor in a gas furnace according to the present invention.
Figure 8:
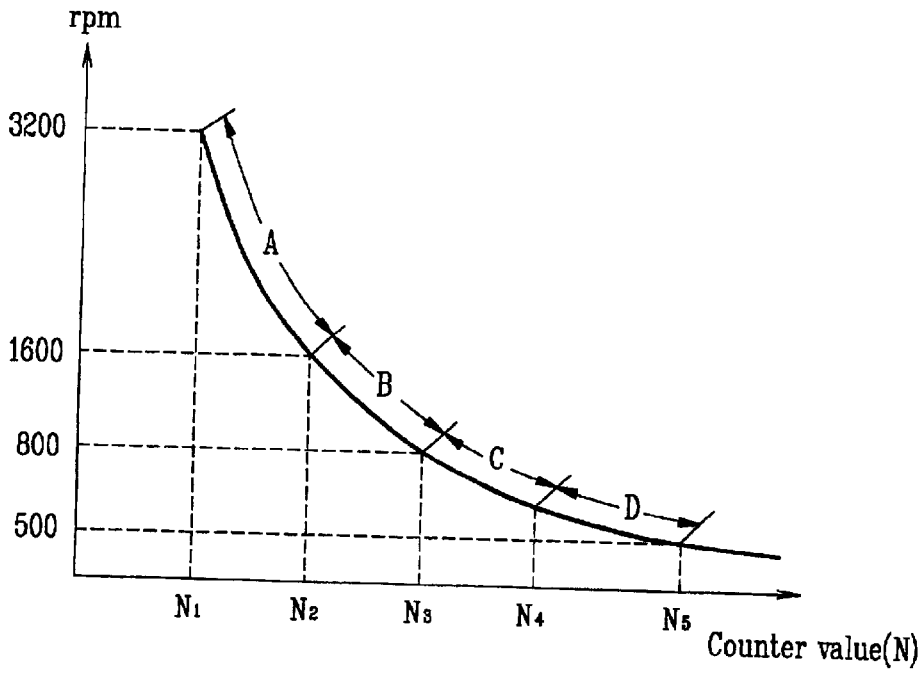
FIG. 8 is a third preferred embodiment of a method for sensing a velocity of the fan motor in the gas furnace according to the present invention.

FIG. 4 illustrates a graph of a calorific value according to a PWM count value of a gas valve according to the present invention. FIG. 5 illustrates a graph of an air quantity according to an RPM of a fan motor according to the present invention. FIG. 6 illustrates a graph of a calorific value control according to the present invention. FIG. 7 illustrates a first preferred embodiment of a method for sensing a velocity of the fan motor in a gas furnace according to the present invention. FIG. 8 illustrates a third preferred embodiment of a method for sensing a velocity of the fan motor in the gas furnace according to the present invention.

Performance in combustion of the gas furnace may be represented by the calorific value. The calorific value is almost determined by a gas quantity controlled by the gas valve, and also affected by a hysteresis quantity when the gas valve is opened and closed, load characteristic of a burning system, kind of a burner, an excessive air ratio, etc.

Here, in the gas valve, the gas quantity is controlled in a manner that strength of a magnetic field of a solenoid in the inside is varied according to an average voltage value of a PWM(Pulse Width Modulation) signal of a controller, whereby PWM count values (GVcnt) obtained by counting an "on" duty interval of the PWM signal are in proportion to the gas quantity. That is to say, the longer the "on" duty interval of the PWM signal is, the higher the average voltage applied to the solenoid of the gas valve is and the larger opening of the gas valve is, with the result that large quantity of gas is provided. Therefore, the gas quantity and the PWM count value (GVcnt) may be regarded as an identical conception.

As shown in FIG. 4, which illustrates a graph resulted after experimenting a relation between the RPM(Revolution Per Minute) of the fan motor and the air quantity by each calorific value, the fan motor RPM and the air quantity supplied to a combustion chamber are in proportion to each other.

$$RPMcnt=1/\text{sampling rate}*60/RPM*\text{number of poles}) \quad \text{Formula 1}$$

From the graphs of FIG. 4 and FIG. 5, the relation between the PWM count value (GVcnt) and the fan motor RPM count value (RPMcnt) is shown in a graph of FIG. 6. Here, the fan motor RPM count value (RPMcnt) is obtained by counting each cycle of pulses, which are generated in a course of detecting poles of the fan motor to detect the RPM pulses, at a predetermined sampling rate. The relation between the RPMcnt and the RPM is defined in the Formula 1. According to the Formula 1, it is found that the RPMcnt and the RPM are in inverse proportion to each other. In other words, if the RPM is high, the fan motor RPMcnt becomes low, since the cycle of the pulses generated during detecting the poles of the fan motor becomes shorter. If the RPM is low, the fan motor RPMcnt becomes larger, since the cycle of the pulses generated during detecting the poles of the fan motor becomes relatively longer.

$$GVcnt=140-(RPMcnt-1663)*1663*4/(43*RPMcnt) \quad \text{Formula 1}$$

From a predetermined scope of control, 1650 RPM-2750 RPM, in FIG. 6, the relational expression between the fan motor RPM count value (RPMcnt) and the PWM count value(GVcnt) has been made as shown in the Formula 2.

Here, the Formula 2 is a preferred embodiment adaptable to a specific kind of burner. Thus, there may occur a difference in values depending on kinds of burners.

Accordingly, the present invention controls an air fuel ratio, such that a transient phenomenon due to a rapid change in the air fuel ratio, which is the conventional problem, is prevented from being occurred by setting the Formula 2 on the controller. The air fuel ratio control process will be explained herein below in detail.

Once a user changes a temperature control mode by selecting a predetermined temperature control mode, an inducer fan and the gas valve have to be controlled so as for the air fuel ratio to be changed according to a calorific value preset in the pertinent temperature control mode. In contrast to the conventional art where the combustion fan and the gas valve are separately controlled to make the pertinent air fuel ratio at a time, the present invention enables the final air fuel ratio to be obtained even maintaining an optimum performance in combustion by consecutively detecting the fan motor RPMcnt, per micro time, for example, per msec, substituting the detected fan motor RPMcnt for the relational expression to consecutively calculate the pertinent GVcnt, and organically changing the two values.

At this time, the consecutive detection is not achievable in the conventional art which detects the fan motor RPMcnt by counting the pulses for a predetermined period of time. To obviate the conventional problem, there are suggested the first to the third preferred embodiments according to the present invention, which show a method for detecting the RPM. The preferred embodiments will be explained herein below.

Initially, in the first embodiment disclosing the method for detecting the RPM, as shown in FIG. 7, the fan motor RPM of the gas furnace is varied many times for a time shorter than one second, and each cycle (t1, t2 . . . ) of the pulses, which sense the fan velocity, generated in the pulse signal generating part of the fan motor is accordingly varied. Therefore, to correspond to all the RPM variation, each cycle time of the pulses over all points of time where the RPM is variable is measured.

Thereupon, a predetermined number of pulses for sensing the fan velocity during one revolution of the fan motor are detected. Hence, if the predetermined number is, for example, six, each cycle time from the first pulse to the sixth pulse is measured so as to obtain the RPM.

$$\text{RPM}=\text{number of pulses per revolution of motor}\times\text{each cycle time of pulses}\div 60 \qquad \text{Formula 3}$$

As a result, there is established a relation between the pulse frequency and the fan motor RPM as shown in the Formula 3.

To be specific, the frequency is graspable through f=1/t1. Since the predetermined number of pulses are applied for one revolution of the fan motor and the RPM is the revolution per minute, the above Formula is established.

Next, each cycle time of the pulses is measured. The measured time and a preset number of pulses per revolution of the motor are applied to the Formula 3, finally calculating the RPM.

Secondly, the second preferred embodiment showing the method for detecting the RPM will be explained herein below.

In the first preferred embodiment showing the method for detecting the fan motor velocity, the series of works for directly detecting the each cycle time of the pulses and processing the measured values require a high precision.

Therefore, the second preferred embodiment of the present invention discloses a method for measuring the each cycle time of the pulses in an easier manner. Initially, a RPM value corresponding to a value on a counter is preset in the form of ROM table to be proportional to a divided time of the counter.

By way of example, if a value on the counter is 1, 3200 RPM is set, if the count value is 2, 3280 RPM is set, . . . if the count value is n, 600 RPM is set.

Thereafter, the each cycle (t1, t2, . . . ) of the pulses in FIG. 7 is counted by means of the counter. And, the RPM value corresponding to the pertinent count value is selected from the ROM table.

Thirdly, the third preferred embodiment showing the method for detecting the RPM will be explained herein below.

As shown in FIG. 8, the method for calculating the RPM is characterized in performing the steps of subdividing the RPM variation according to the counter value, and compensating for the RPM variation based on the following Formula 4.

$$\text{RPM}=a\times N+b \qquad \text{Formula 4}$$

As illustrated in FIG. 8, the counter value is in inverse-proportion to the RPM. If the inverse proportion relation is expressed in a linear function, it may be expressed as shown in the Formula 4.

Here, the RPM represents y, a represents gradient, N represents x value, and b represents y intercept.

Meantime, since the graph of FIG. 8 is of a parabolic shape, the graph is subdivided into A, B, C and D intervals, and a set of a value and b value corresponding to each interval, namely $(a_A,b_A)$ $(a_B,b_B)$ $(a_C,b_C)$ $(a_D,b_D)$, are preset.

Then, the counter value and the set of a value and b value of the pertinent interval are selected. The selected values are applied to the Formula 4 to calculate the RPM.

Here, as shown in FIG. 8, if N value is 15 between $N_2$ and $N_3$, the N value is included in the B interval. Thus, $(a_B, b_B)$ as the set of a value and b value, and 15 as the N value are applied to the Formula 4, so as to calculate the RPM.

A current PRM is compensated by using the RPM calculated through the Formula 4.

In consequent, the first to the third preferred embodiments as previously described ensure the optimum air fuel ratio regardless of the temperature control by detecting the RPM, and applying the pertinent RPMcnt value to the Formula 2.

Further, a digital PD control system, which determines a control voltage applied to the fan motor in order to control the fan motor RPM, is used to maintain a specified calorific value.

As stated above, the method for controlling the air fuel ratio in the gas furnace according to the present invention has an advantage of maintaining the optimum performance in combustion irrespective of the temperature variation, since current gas quantity and air quantity are varied until the air fuel ratio reaches an objective value through a complementary reaction, serving to prevent a transient phenomenon.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method for controlling an air fuel ratio in a gas furnace, comprising:

determining a rotational speed of a fan motor of the furnace;

detecting a variation in a heat output rate of the furnace based on a pulse width modulation count value;

detecting a variation in air flow rate based on a variation in the rotational speed of the fan motor;

detecting a variation in the pulse width modulation count value based on the variation in the rotational speed of the fan motor;

determining a relational expression between the rotational speed of the fan motor and the pulse width modulation count value based on the variation in the pulse width modulation count value;

applying the detected rotational speed of the fan motor to the relational expression until the heat output rate reaches a preset heat output rate; and controlling operation of a gas valve of the furnace based on the pulse width modulation count value.

2. The method of claim 1, wherein the fan motor is driven by a predetermined voltage.

3. The method of claim 2, wherein the rotational speed of the fan motor is based on a cycle time associated with a plurality of pulse signals generated during revolution of the fan motor.

4. The method of claim 1, wherein the fan motor is driven by a predetermined pulse signal comprising a plurality of cycles of pulses, and a corresponding number of revolutions of the fan motor based on the plurality of cycles of pulses.

5. The method of claim 4, wherein determining a rotational speed of the fan further comprises measuring a cycle time for each of the plurality of cycles of pulses and calculating a number of revolutions per minute of the fan motor.

6. The method of claim 4, wherein the number of revolutions of the fan motor per cycle is selected based on a number of cycles counted by a counter.

7. The method of claim 1, wherein the fan motor is driven by at least one predetermined pulse signal.

8. The method of claim 7, further comprising counting each cycle of the at least one pulse signal, and determining a corresponding count value.

9. The method of claim 8, wherein determining a rotational speed of the fan motor further comprises detecting a number of revolutions per minute of the fan motor based on the count value and a linear function associated with the rotational speed of the fan.

10. A method for controlling an air fuel ratio in a gas furnace in which a fan motor is driven by a specified voltage, cycle times of pulse signals generated during revolution of the fan motor are measured, revolutions per minute of the fan motor on the measured cycle times, and an opening of a gas valve is controlled based on an average voltage of a pulse width modulation signal applied by a controller, the method comprising:

detecting variation in a calorific rate associated with a heat output requirement of the furnace based on variation in a pulse width modulation count value, and of detecting a variation in an air flow rate based on variation in revolutions per minute of the fan motor;

detecting variation in the pulse width modulation signal based on the variation in the revolutions per minute of the fan motor, the variation in calorific rate and the variation in air flow rate, and deriving a relational expression between the revolutions per minute of the fan motor and the pulse width modulation count value based on the variation in the pulse width modulation signal; and applying the detected revolutions per minute of the fan motor to the relational expression until a calorific rate associated with a heat output requirement of the furnace reaches a level preset in a temperature control mode by a user when performing a burning operation of the gas furnace, and accordingly controlling the gas valve with the pulse width modulation count value.

* * * * *